United States Patent [19]

Zaruba et al.

[11] Patent Number: 4,571,210

[45] Date of Patent: Feb. 18, 1986

[54] TOY PLAYSET ELEVATOR

[75] Inventors: John V. Zaruba; Michael A. Andersen, both of Chicago; Burton C. Meyer, Downers Grove, all of Ill.

[73] Assignee: Marvin Glass & Associates, Chicago, Ill.

[21] Appl. No.: 699,070

[22] Filed: Feb. 7, 1985

[51] Int. Cl.[4] ..... A63H 33/30; A63H 11/04

[52] U.S. Cl. ..... 446/424; 446/315; 446/479

[58] Field of Search ..... 446/315, 314, 323, 322, 446/476, 479, 424, 491, 228, 268, 477, 490, 361

[56] References Cited

U.S. PATENT DOCUMENTS

| | | | |
|---|---|---|---|
| 195,011 | 9/1877 | Ireland | 446/476 |
| 1,579,602 | 4/1926 | Esser | 446/315 |
| 3,054,214 | 9/1962 | Smith et al. | 446/424 X |
| 3,071,895 | 1/1963 | Gelfand et al. | 446/424 |
| 4,087,932 | 5/1978 | Rosenthal et al. | 446/315 |
| 4,244,136 | 1/1981 | Kublan | 446/228 |

*Primary Examiner*—Mickey Yu

*Attorney, Agent, or Firm*—John S. Pacocha

[57] ABSTRACT

An elevator for a toy playset has a drum wound cable attached to a carrier for toy figures. The carrier includes an elongated, open bottomed shell into which is secured a folded piece of high density foam material, such as foam polyethylene. Compressed together opposed faces of the material form a slit along the length of the open bottom of the shell. Hands of a toy figure are inserted into the slit and retained by the compressed foam as the figure is transported by winding and unwinding the elevator drum.

10 Claims, 7 Drawing Figures

TOY PLAYSET ELEVATOR

BACKGROUND OF THE INVENTION

1. Field of the Invention

This invention relates generally to toy playsets and more particularly to toy playsets that have an elevator for raising and lowering a toy figure between one level and another.

2. Background Art

Toy playsets for use with a variety of toy figures and accessories have long been popular playthings. One feature found in such playsets is an elevator, usually child powered, for moving toy figures between levels. Thus, for example, in the castle playset disclosed in U.S. Pat. No. 4,139,967 there is a turntable 66 and an elevator platform 80 each of which are moveable up and down along a helically spiraled pole extending between upper and lower levels. Additional examples of elevators for raising and lowering toy figures are found in Kenner's Ewok Village Action Playset, Mattel's Barbie Townhouse, Mattel's Secret Wars Tower of Doom and Mattel's Masters of the Universe Castle Grayskull. Nevertheless, there remains a need for relatively simple to use and entertaining elevators for transporting toy figures in playsets.

SUMMARY OF THE INVENTION

The present invention is concerned with providing an elevator for toy figures in a playset. This and other objects and advantages of the invention are achieved by providing a laterally extendable rotatable drum for winding and unwinding a cable to which is secured a carrier for toy figures. The carrier is a horizontally elongated shell that is open at the bottom and has an eye on top for receiving the cable. Inserted into the open shell is a folded piece of compressible material such as foam polyethylene with the folded end adjacent the inside top of the shell. The compressed together faces form a slit lying along the length of the open bottom of the shell for insertion and retention of the hands of a toy figure while it is transported.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
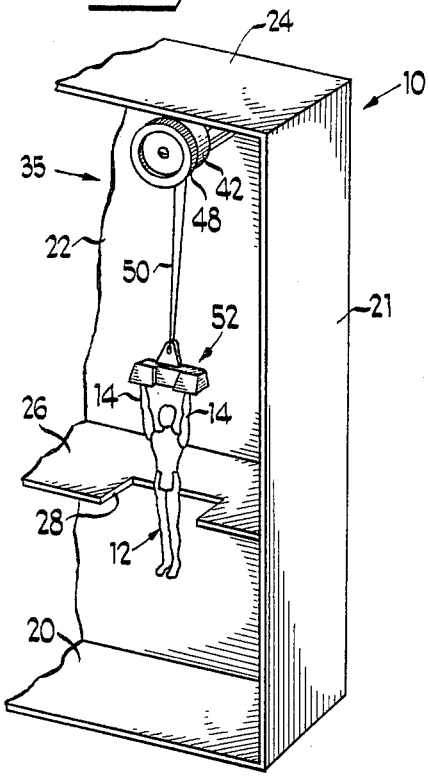
FIG. 1 is a partial perspective view of a playset embodying the present invention.
Figure 3:
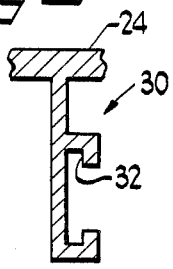
FIG. 3 is a sectional view taken generally along line 3—3 of FIG. 2.
Figure 4:
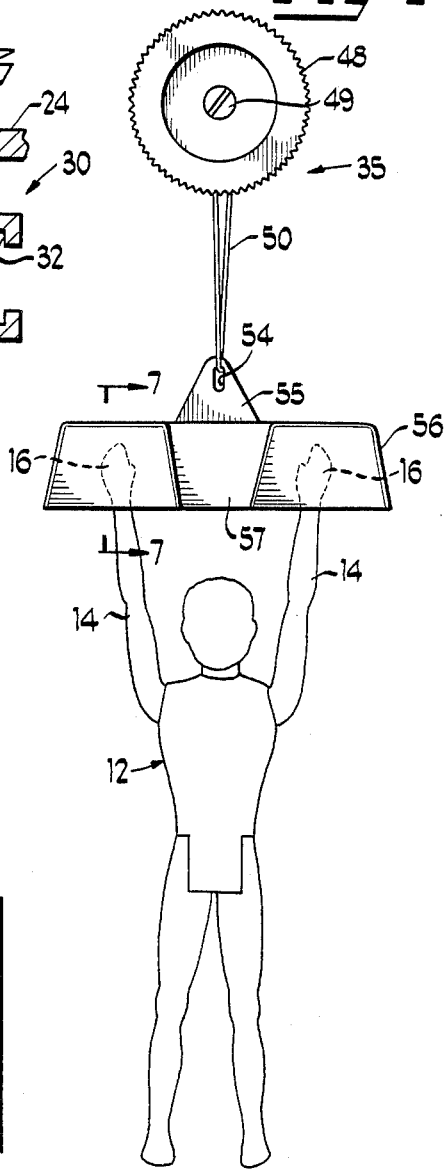
FIG. 4 is an enlarged scale front elevational view of the elevator with a toy figure secured in the carrier.

Referring now to the drawing in which like parts are designated by like reference numerals throughout the several views, there is shown in FIG. 1 a portion of a multilevel playset 10. As in prior art playsets, the portion shown is part of one of at least two members which fold together to form a storage-carrying case for accessories and toy figures such as 12 used with the playset. Figure 12 is preferably articulated, at least to the extent of permitting the arms 14 with hands 16 to be moved to the upraised position illustrated in FIGS. 1 and 4. The figures may be of different sizes although approximately three and one-half inch tall figures are often used in playsets of the type to which this invention is directed.

Playset 10 includes a base 20 that is generally flat so that the playset may be positioned upon a planar surface, plus a sidewall 21, backwall 22, top 24 and an intermediate level 26. Conveniently, intermediate level 26 is provided with an opening 28 facilitating the transport of a toy figure between base 20 and intermediate level 26. Depending from the inside of the top wall 24 is a slide mount 30 that has a C-shaped channel 32. The back end of mount 30 is also secured to the backwall 22 of the playset. Conveniently, slide mount 30 may be integrally molded as part of top 24 and backwall 22.

Elevator 35 is received for sliding movement in mount 30. The elevator includes a cantilevered beam 36 having a slot 38 extending from the back end of the beam toward, but not all the way to, the front of the beam. Throughout most of its length the height of the beam is less than the height of the C-shaped channel 32. However, at the back end there is an enlargement 40 such that the height of the beam from the bottom of enlargement 40 up to the top approximates the height of the C-shaped channel 32. Slot 38 permits the beam to be compressed slightly for insertion into the channel.

Mount 30 is recessed inwardly from the front edge of top wall 24. Accordingly, when beam 36 of elevator 35 is pushed all the way into channel 32, the front of the elevator is generally aligned with the front edge of top wall 24. This facilitates the folding together of the portion of the playset that is shown with another portion (not shown) as is done in the prior art. At the front end of beam 36, a drum housing 42 is secured to the bottom of the beam or may be integrally formed with the beam. Adjacent the front of housing 42 is an opening 43. Whatever method of manufacture is used, a large boss 44 is provided to strengthen the junction between the housing and the beam. Beneath the boss is a laterally extending lip 45.

Received for rotation about a concentric axis in housing 42 is a drum 46 the outside periphery of which is provided with serrations 48 to facilitate manual rotation of the drum. A screw 49 secures the drum to the back of the housing 42 to prevent the drum from being pulled out of the housing during play. One end of a string or cable 50 is secured to the rotatable drum passing down through opening 43 and the other end is secured to the stationary lip 45. Cable 50 is conveniently about twice the length of the distance from the drum to the bottom wall 20 although it may be somewhat shorter.

Figure 6:
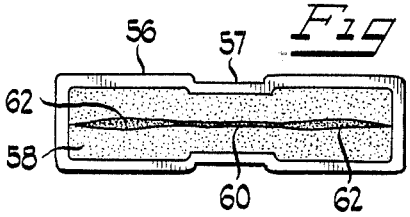
FIG. 6 is an enlarged scale bottom plan view of the carrier.
Figure 5:
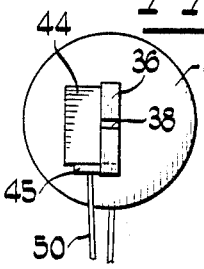
FIG. 5 is an enlarged scale, rear elevational view of the elevator.
Figure 7:
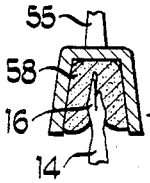
FIG. 7 is a sectional view taken generally along line 7—7 of FIG. 4.

Prior to securing the one end of the cable to lip 45, carrier 52 is attached. The cable is passed through an eye 54 of a hanger 55 integrally formed on a generally trapezoidal carrier shell 56. As is best shown in FIG. 6, the shell 56 is conveniently wider adjacent the ends with a necked down center portion 57. Inserted within the shell 56, and conveniently secured by a suitable adhesive, is a high density foam material 58 such as foam polyethylene. Among other suitable alternatives are foam or sponge rubber.

Material 58 is folded over and inserted into shell 56 with the folded end inserted toward the top of the shell. The separation, or slit 60, formed by the compressed together opposing faces is exposed along the length of the bottom of the carrier shell 56. Slit 60 may conveniently be widened or enlarged slightly adjacent the ends by removing some material on opposing faces prior to folding and inserting the foam to form pockets 62. The necked down center of carrier shell 56 keeps the material 58 more tightly compressed at the center while permitting some penetration, or separation, of slit 60 by the hands of a toy figure. In addition, the upward taper of ends and sides of the trapezoidal shell keeps the foam material more tightly compressed away from the bottom to help retain the smaller fingered ends of the hands. Although a single folded piece is preferred, two separate pieces of foam may be used.

Figure 2:
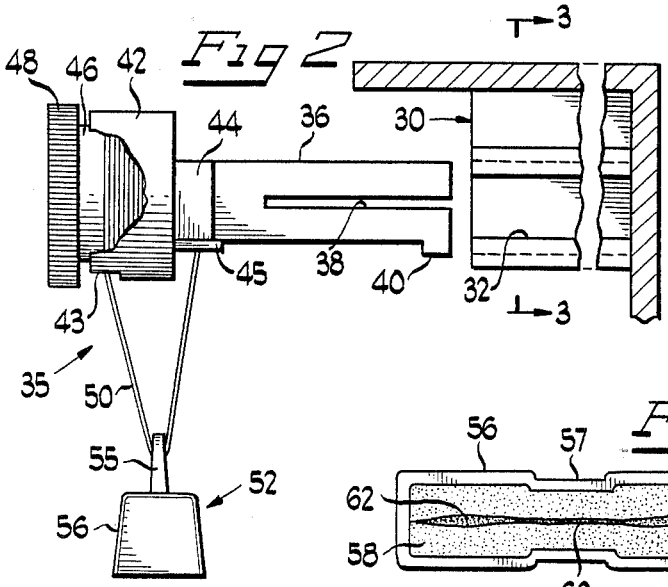
FIG. 2 is an enlarged scale, side elevational view of the elevator and part of the elevator mount.

In play, elevator 35 is partially pulled out of the C-shaped slot 32 of slide mount 30. Cantilevered support of the elevator in such an extended position is facilitated by enlargement 40 at the back end of beam 36 which provides the tightest engagement at the most rearward position to eliminate wobble. Elevator 35, or more particularly carrier 52, is lowered by rotating the drum in a clockwise direction as the elevator is illustrated in FIG. 2. Hands 16 of the toy figure are then pushed into slit 60 between the compressed together opposed faces of the foam material. The compressed foam exerts sufficient pressure on the hands to support the figure as the elevator drum is then rotated in the reverse counterclockwise direction to raise carrier 52 and figure 12.

A particular embodiment of the present invention has been shown and described with some changes and modifications. The invention may be adapted to transport toy figures generally horizontally rather than vertically as illustrated. Further such changes and modifications will occur to those skilled in the art. It is intended in the appended claims to cover all such changes and modifications as fall within the true spirit and scope of the present invention.

What is claimed as new and desired to be secured by Letters Patent is:

1. A toy playset elevator comprising:

a playset wall supportable on a surface and having a predetermined height;

a rotatable drum carried by the wall at a fixed height above the surface;

a length of cable attached to the drum for winding and unwinding about the drum;

a carrier for a toy figure attached to the length of cable so that the carrier is transported as the cable is wound and unwound about the drum;

the carrier including an elongated, open bottomed shell;

a foam material having opposed faces inserted into the shell forming a slit along the length of the open bottom; and the foam material being sufficiently resilient and having a high enough density such that the hands of a toy figure may be inserted into and retained by the slit so that the figure may be transported by winding and unwinding the drum.

2. The toy playset elevator of claim 1 in which the foam material is a single piece that is folded with the fold being inserted toward the top of the shell.

3. The toy playset elevator of claim 1 in which:

the rotatable drum has an axis and is attached to a beam;

the length of the beam being generally parallel to the axis of the drum; and the playset includes a mount receiving the beam for sliding movement.

4. The toy playset elevator of claim 3 being slidably moveable in the mount between a stored position and an extended cantilevered position.

5. The toy playset elevator of claim 1 in which:

one end of the cable is attached to the drum;

the other end of the cable is secured to a stationary part of the elevator;

the carrier has an upwardly extending hanger with an eye; and the cable freely passes through the eye.

6. The toy playset elevator of claim 1 in which the shell is generally trapezoidal.

7. The toy playset elevator of claim 6 in which the elongated shell extends between two ends and the shell is wider adjacent the ends.

8. The toy playset elevator of claim 1 in which the elongated shell extends between two ends and the slit is enlarged adjacent the ends by removal of some material from the opposing faces.

9. The toy playset elevator of claim 1 in which the elongated shell extends between two ends and the shell is wider adjacent the ends.

10. The toy playset elevator of claim 1 in which the shell has sides that taper inwardly from the open bottom.

* * * * *